United States Patent [19]

LeFranc et al.

[11] 4,412,403

[45] Nov. 1, 1983

[54] TELESCOPING GRANDSTAND ARRANGEMENT

[76] Inventors: Christiane LeFranc, 72, avenue du Midi, 63800 Cournon; Francois Verdier, 46, Boulevard Cote Blakin, 63000 Clermont-Ferrand, both of France

[21] Appl. No.: 380,566

[22] Filed: May 21, 1982

[51] Int. Cl.[3] ..... E04H 3/12

[52] U.S. Cl. ..... 52/9; 52/64; 52/79.5; 52/143; 296/64

[58] Field of Search ..... 52/6, 8, 22, 64, 79.5, 52/143, 7, 9, 10; 297/107; 296/64

[56] References Cited

U.S. PATENT DOCUMENTS

| | | | |
|---|---|---|---|
| 2,136,130 | 11/1938 | Gorlenko | 52/8 |
| 2,587,159 | 2/1952 | Holmes | 52/143 |
| 2,663,914 | 12/1953 | Mackintosh | 52/9 |
| 3,001,243 | 9/1961 | Conn et al. | 52/10 |
| 3,181,203 | 5/1965 | Wenger | 52/6 |
| 3,217,366 | 11/1965 | Wenger | 52/6 |
| 3,752,531 | 8/1973 | Jones | 52/8 |
| 3,885,827 | 5/1975 | Sanders | 52/8 |
| 3,914,909 | 10/1975 | McNeal | 52/9 |
| 4,103,462 | 8/1978 | Freller | 52/143 |

FOREIGN PATENT DOCUMENTS

| | | | |
|---|---|---|---|
| 124122 | 8/1931 | Fed. Rep. of Germany | 52/9 |
| 804129 | 2/1951 | Fed. Rep. of Germany | 52/6 |
| 702919 | 4/1966 | Italy | 52/9 |
| 771305 | 10/1980 | U.S.S.R. | 52/10 |

OTHER PUBLICATIONS

Le Franc "Group Pictures . . . A Very Profitable Opportunity" (Brochure).

*Primary Examiner*—John E. Murtagh
*Assistant Examiner*—Mark J. Sofia
*Attorney, Agent, or Firm*—Lee C. Robinson, Jr.

[57] ABSTRACT

A transportable grandstand or bleachers designed for seating of persons has a trailer frame mounted on wheels and a tongue or other towing arrangement. A first "top" group of tiers is permanently mounted on the frame and a second "bottom" group of tiers is hingedly jointed on the first group on a hinge axis parallel to the length of the tiers. The second group can be swung about this axis to a travelling position where the second group is folded atop the first group, and can be unfolded into a position for use. The first and second groups of tiers each have a generally hollow prismatic or tubular structure, with similarly shaped inside groups of tiers disposed therewithin. The first and second groups of tiers serve as outside groups and house the associated inside groups of tiers therewithin. The inside groups can be slid laterally out from within said outside groups, in a telescoping fashion, to increase the seating capacity of the arrangement. A rod can be attached to a stiffening number within the outer group and slide in a hole in a corresponding stiffening member in the inside group. A head or knob on the rod limits lateral motion of the inside group so that the latter is not pulled out completely.

10 Claims, 4 Drawing Figures

TELESCOPING GRANDSTAND ARRANGEMENT

BACKGROUND OF THE INVENTION

This invention relates to movable structures, and is more particularly directed to a portable bleachers, grandstand, or platform arranged in tiers, of the type designed to permit the positioning of persons so that those persons can be clearly seen by another person, such as a photographer, or so that the persons present on the grandstand can have a broad and unobstructed field of view, for example, for observing a sports or entertainment event.

Stone tiers of seats have been in existence since the days of Antiquity; the manner of building grandstands using scaffolding techniques has become known in more modern times. Modern-day photographers have taken to the familiar practice of positioning persons, at weddings, for example, or wooden tiers or benches that can easily be transported; unfortunately the resulting lack of safety resulting from this practice has also become all too familiar.

In particular, French Pat. No. 2,274,755 (McNeal), U.S. Pat. No. 3,217,366 (Wenger), U.S. Pat. No. 3,752,531 (Tones), and West German Pat. No. 804,129 (Priess) disclose portable grandstand devices more specifically designed to hold individuals so that they can witness an event: Some of these devices have two groups of tiers, one of which unfolds about a horizontal axis to bring the tiers into position for use, the tiers of this group fitting into those of the first group while in a transport position. Although these devices are quite practical and advantageous as regards setting them up, if we compare them with grandstands erected on-site, for example by use of scaffolding, they have a disadvantageous lack of seating capacity for the total size of the device.

OBJECTS AND SUMMARY OF THE INVENTION

And object of this invention is to provide a bleachers, platform, or grandstand that can be very quickly set up, for example following transport thereof from one geographical place to another, that provides safe seating or standing for persons positioned on or seated on it, and in which the number of spectators' seats, when opened, relative to the bulkiness of the device, when folded up, is considerably greater than that of prior-art devices.

According to an aspect of this invention, a grandstand comprising a plurality of tiers, and particularly designed for the positioning of persons for the purpose either of photographing them or of enabling them to watch a show, a convention, or other spectacle, has a frame mounted on wheels and equipped with a tongue or other towing arrangement with a first "top" gang of tiers permanently mounted on the frame, and a second "bottom" gang of tiers hingedly jointed on the first gang about a horizontal axis parallel to the tiers of the first and second gangs. The second gang can be pivoted around the axis so as to be folded up and fitted into the first gang in a "travelling" position, and can be unfolded into position for use. Each of these first and second gangs of tiers has an "outside" group of tiers arranged as a hollow prismatic or tubular structure, and each of such outside groups serves as a housing for at least one group of "inside" tiers of similar form that can be removed laterally therefrom by sliding. That is, the inside tiers and the outside tiers have a "telescopic" relation to each other.

As a result of the aforesaid construction according to this invention, the usable area, i.e., the number of spectators' seats available, for the tiers of the first and second gangs can be doubled by pulling out the inside groups of tiers; moreover, the telescoping nature of the arrangement of the inside tiers in relation to the outside tiers makes setting-up quite easy and extremely rapid.

Preferably, each group of outside tiers has in its mid-section stiffening members or stiffeners, disposed in a plane perpendicular to the length of the tiers. Moreover, stops are positioned at the ends of the groups of outside and inside tiers so as to prevent the inside tiers from sliding out completely.

According to a preferred arrangement, terminal stiffeners on the inside tiers serve, in position for use, as terminal stiffeners for the outside tiers also.

According to a preferred embodiment, each tier is formed of a vertical portion and a horizontal portion, the horizontal portion being constituted by two horizontal stages connected by a wall that a wall that is more or less vertical. This structure is particularly advantageous and suitable for achieving transversal stiffening of tubular structures, so that the vertical wall serves not only to delimit the area where the spectators on a tier can sit and the area where the feet of the spectators seated on the tier above it can rest, but also to stiffen the tiers.

Again preferably, and in keeping with another advantage of the invention, vertical slidebars are positioned near terminal angles of at least the top inside groups, such slidebars being designed to permit detachable connection, on the one hand, of parts functioning as supporting props and reaching down to the ground, and, on the other hand, of handrail bar posts extending upwards. Preferably, these slidebars extend beyond the transverse section of the inside tiers so as to form stops for the insertion of the tiers into the outside tiers, and gripping devices for pulling out the inside tiers.

Also preferably, and in keeping with still another advantage, pull-out stops are formed by rods, one end of each of which is attached to the stiffeners positioned in the mid-section of the outside tiers, while the other end of each such rod has a "head", said rods being positioned to slide in holes of the stiffeners for the groups of inside tiers. As a result of this arrangement, these stop devices are not visible on the outside of the tiers when the gangs of tiers are unfolded.

An advantageous dimensional arrangement of one particular embodiment of a grandstand according to the invention, has one tier approximately forty centimeters high, with its total width being sixty centimeters; and has each each stage twenty-five centimeters wide, with the wall connecting them, being consequently a sloping or oblique riser wall, being ten centimeters high.

The distance between the joint axis and the part of the bottom outside tier group that is lowest after unfolding is preferably equal to the distance between the joint axis of the bottom portion and the wheels of the frame.

The principles of this invention will be better understood, and the relevant details will become more evident from the ensuing description of a particular embodiment, which is to be considered in conjunction with the annexed illustrations.

DETAILED DESCRIPTION OF A PREFERRED EMBODIMENT

Figure 1:
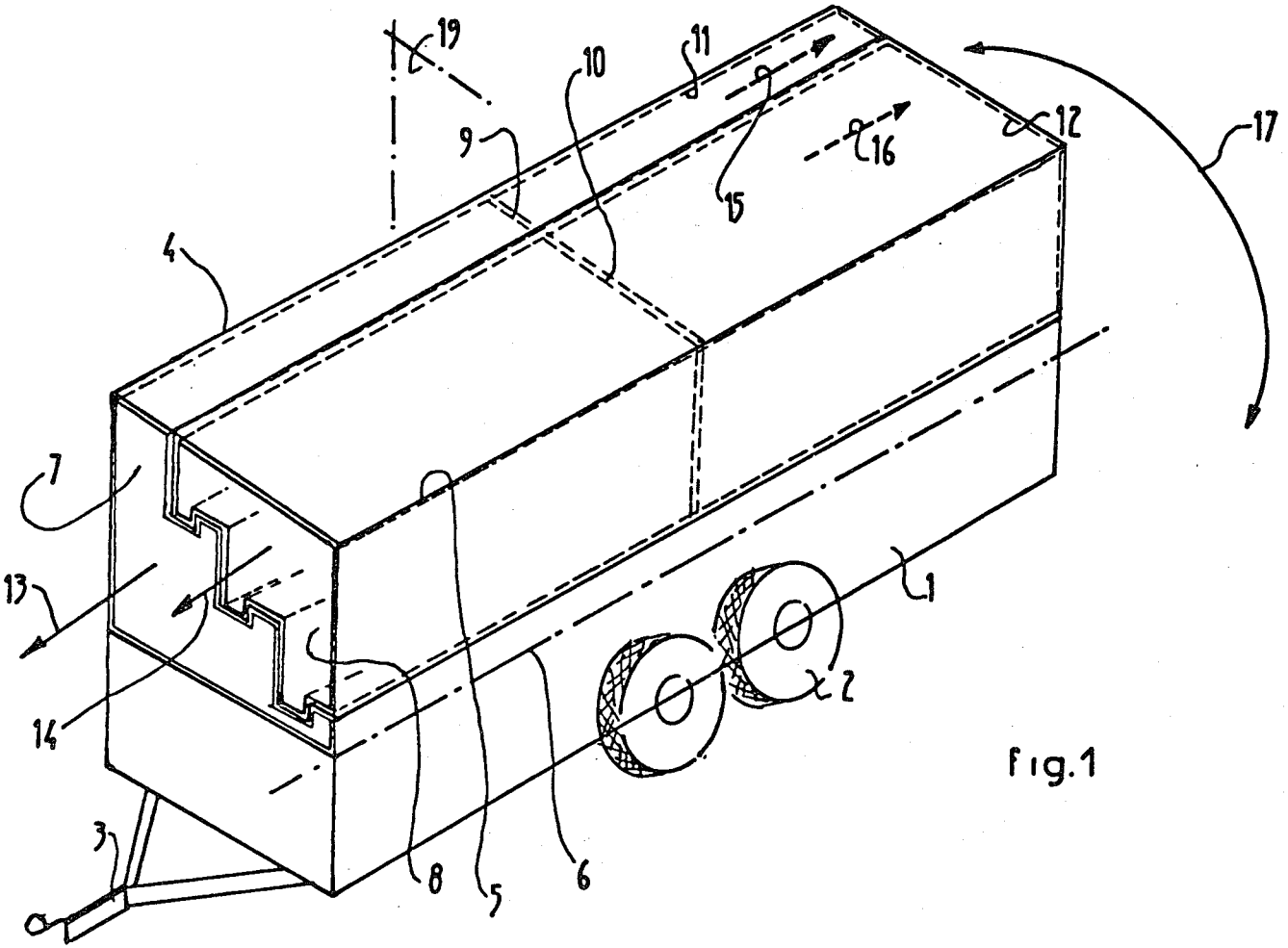
FIG. 1 is a diagrammatic perspective view of a grandstand device according to the present invention, in a folded or "travelling" position.

With reference to the drawings and initially to FIG. 1 thereof, a trailer arrangement to form a tiered grandstand according to the present invention chiefly comprises a frame 1 mounted on wheels 2 and is attachable to a vehicle by means of a tongue 3. Above the frame is positioned a first group of tiers 4 that are stationary in relation to the frame and a second group 5 that is hingedly jointed to the first group about a horizontal axis 6. The tiers of the first group 4 are called "top" tiers since they will be positioned in the upper portion of the grandstand; the tiers of the second group are called "bottom" tiers since after pivoting on the axis 6 they will form the lower portion of the grandstand.

Each of the above-mentioned groups 4 and 5 has a hollow or tubular prismatic structure designed to hold, telescopically, "inside" groups of tiers 7 and 8, respectively, similar in structure to the outside groups of tiers 4 and 5.

In the preferred embodiment shown in FIG. 1, the length of the inside groups of tiers 7 and 8 is approximately one-half the length of the corresponding outside groups of tiers 4 and 5, so that each group of outside tiers contains two groups of inside tiers.

This division into two of the inside tiers affords the presence of stiffeners 9 and 10 in the mid-section of the outside tiers. Groups of inside tiers 11 and 12 similar to groups 7 and 8 are positioned in the outside tiers symmetrically to these outside tiers in relation to the stiffeners 9 and 10.

Because of their telescopic nature, the groups 7 and 8 can slide in the respective directions of arrows 13 and 14 out from the front end of the trailer, while the groups 11 and 12 can slide in the same manner in the respective directions of arrows 15 and 16 out of the rear end of the trailer.

The gang of the bottom tiers 5, 8, 12 can pivot about the axis 6 in the direction of arrows 17.

Figures 2, 3, 4:
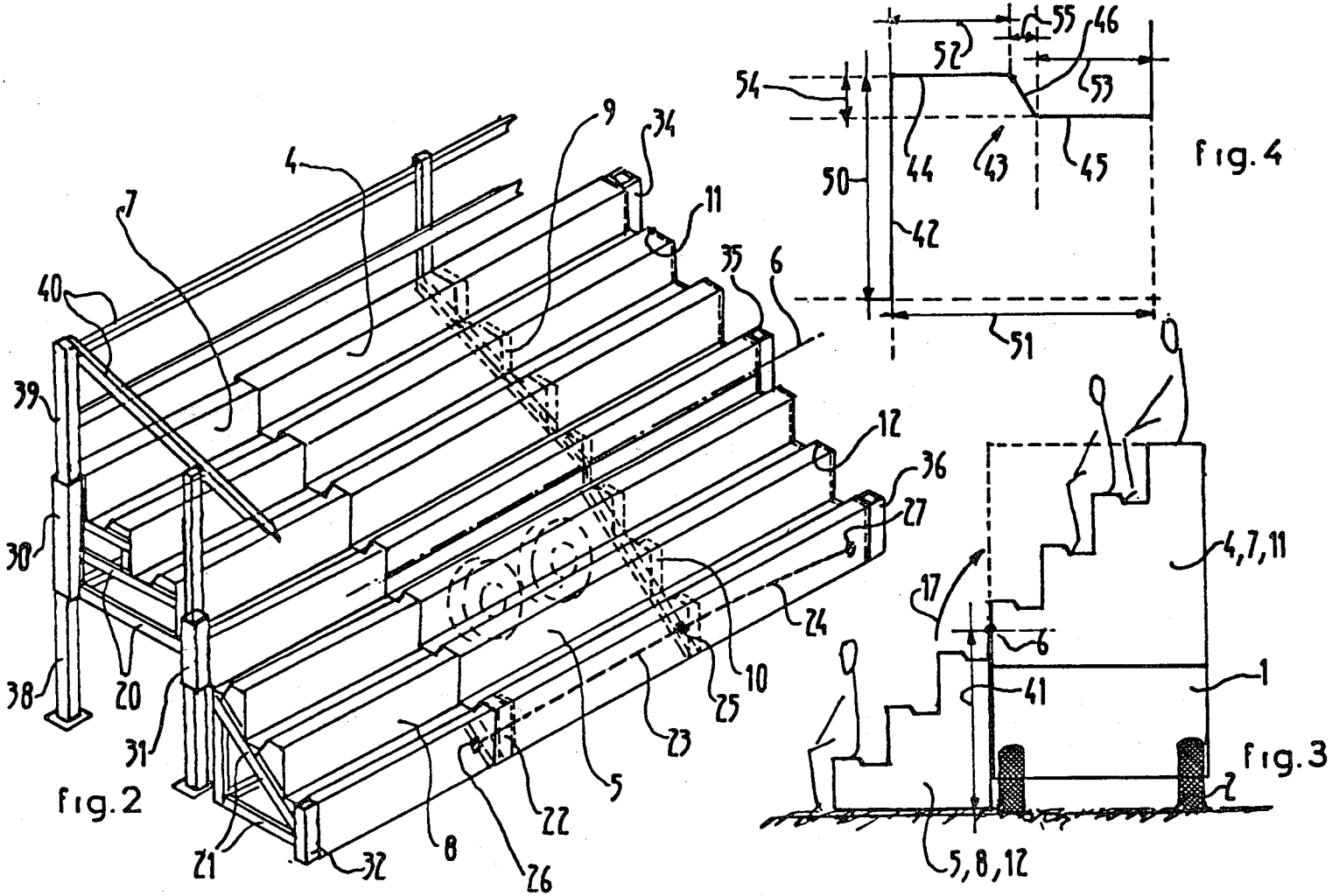
FIG. 2 is a partial perspective view of the same device in an unfolded position, after certain inside tiers thereof have been pulled out.
FIG. 3 is a diagrammatic cross-section across a vertical plane of the grandstand of FIG. 2, shown in use and illustrating certain dimensional features.
FIG. 4 is a diagrammatic cross-section of one tier of the grandstand of the preceding figures illustrating other dimensional features.

The towable grandstand of FIG. 1 is shown in FIG. 2 in an unfolded position, in which only the groups of bottom tiers of the front end, that is, groups 7 and 8, have been slid out of the groups of outside tiers 4 and 5. Visible at the bottom end of groups 7 and 8 are stiffener devices or structures formed, for example, by tubular units 20, for the top tiers and similar tubular units 21 for the bottom tiers. In FIG. 2, the structures of these units 20 and 21 are shown as being different, not because of any technical necessity but only in order to illustrate the various possibilities of embodying the same, and it must be understood that those structures could be similar, whether in one form or the other. These stiffening structures or devices are located at both ends of each of the groups of inside tiers 7, 8, 11, and 12, whether top or bottom or front end or rear end. A stiffening device 22 provided at the second or inner end of the group of tiers 8 has been partially shown in ghost lines.

These stiffening devices or structures are positioned again as the stiffeners 9 and 10 in the mid-plane 19 of the top and bottom outside tier groups 4 and 5, and construction of the stiffening devices 20, 21, and 22 for the inside tiers can also be used for these stiffening devices 9 and 10 for the outside tiers.

It is also evident that the stiffening devices 9 and 10, occupying a portion of the internal space of the tiers, form an inside or insertion stop for the inside tier groups 4, and 5.

It will further be noted that the stiffeners 22 act not only as stiffeners for the inside tiers in which they are incorporated but also as stiffeners for the outside tiers at the end of which the inside tiers 7, 8, 11, and 12 remain housed even after pull-out.

Stiffening structures 22 also servo a pull-out-stop function oweing to rods 23 and 24 attached at a point 25 on the stiffener 10 of the mid-portion, and mounted to slide in holes in the stiffeners 22. These rods 23 and 24 have heads 26 and 27 against which the stiffening devices 22 come a stop.

Again in FIG. 2, vertical slidebars 30 and 31 are positioned near terminal angles of the top inside tier group 7; the same is understood to be true for slidebars 34 and 35 for the other top inside their group 11. Slidebars 32 and 36 are positioned at the bottom end angle of bottom inside tier groups 8 and 12, respectively, these slidebars being designed to permit detachable connection of devices functioning as props 38 or handrail bars 39, on which hand rails 40 are mounted.

FIG. 3 is a diagrammatic cross-section of this embodiment of the grandstand according to the present invention, through a transverse median vertical plane. The preferred embodiment provides, for the top tier groups 4, 7, and 11, four tiers—that is, the possibility of positioning four rows of seated individuals—and for bottom-tier groups 5, 8, 12, three tiers, which after pivoting around axis 6 can be stowed atop the top tiers. If the distance 41 between the joint axis 6 and the portion that is lowest after unfolding of the bottom outside tier group is equal to the distance separating this axis of the bottom portion from the wheels, the bottom tier group will rest on the ground when in its unfolded position.

As shown in FIG. 4, each tier consists of a vertical portion or riser 42, and a horizontal portion 43; the horizontal portion in turn consists of two horizontal stages 44 and 45 connected by a wall 46 that is inclined or more or less vertical. The stage 44 can serve as seating while the stage 45 can serve as a foot-rest for the spectators seated on the tier next above. Another function of this structure of the horizontal portion is to obtain, oweing to the presence of a wall or riser 46, a stiffening of the structure particularly because of the tubular nature of this structure. This embodiment, if constructed according to the following preferred dimensions, well satisfies all the functions requisite to the grandstand, i.e., permitting the same to the towable for travelling, while providing optimum safe arrangement of the persons seated or standing thereon. The tier riser 42 has a height 50 of approximately forty centimeters, its total width 51 is approximately sixty centimeters, the stages 44 and 45 each having a respective width 52 and 53 of twenty-five centimeters, while the height 54 of the oblique wall or riser 46 has a vertical height of about ten centimeters for a horizontal stagger 55 of about five centimeters.

Although one particular embodiment of a towable grandstand according to this invention has been described in detail hereinabove, it is to be understood that many variations and modifications thereof would be apparent, without departing from the scope and spirit of this invention, which is defined by appended claims.

What is claimed is:

1. In a tiered grandstand arrangement of the type adapted to support individuals for purposes including group photography of the individuals and seating thereof to watch a show, conference, or other event, and of the type formed of a frame mounted on wheels and equipped with means to permit towing to a desired location, comprising a first, top group of tiers being permanently mounted on said frame, and a second, bottom group of tiers hingedly joined to the first group about a horizontal axis parallel to the length the tiers of the first and second groups thereof, the second group being pivotally movable about said axis to be folded onto and placed atop the first group for travelling, and to be unfolded therefrom into an opened position for use; the improvement wherein each of said first and second groups of tiers has a generally tubular prismatic structure, and there are further provided for each of said first and second groups of tiers at least one inside group of tiers of structure similar to the associated one of said first and second groups of tiers, the latter forming outside groups of tiers relative to said inside groups of tiers and serving as housings for the associated inside groups of tiers, the latter being slideable relative to the outside groups of tiers to permit expansion of the usuable capacity of the first and second groups of tiers by pulling out said inside groups of tiers.

2. A tiered grandstand arrangement according to claim 1; wherein each of said first and second groups of tiers houses a pair of associated groups of inside tiers situated end to end.

3. A tiered grandstand arrangement according to claim 2; wherein each of said first and second groups of tiers has at a midportion thereof at least one stiffening member disposed in a plane perpendicular to the length of said tiers.

4. A tiered grandstand arrangement according to claim 3; wherein each of said inside groups of tiers has at its ends at least one stiffening member disposed in a plane perpendicular to the length of its tiers, and stopping means are disposed coupled to the at least one stiffening member of said first and second groups of tiers and acting with the at least one stiffening member of the associated inside groups of tiers to stop said inside groups of tiers, when pulled out, from being pulled out completely, so that the stiffening members of the inside groups of tiers are also disposed within the telescoped outer groups of tiers so that such stiffening members also serve as stiffening members for ends of said first and second groups of tiers.

5. A tiered grandstand arrangement according to claim 4; wherein said stopping means includes a rod attached to said stiffening member for said midportion of said outside groups of tiers, passing through an aperture in the stiffening member of the associated inside groups of tiers, and having a head disposed at the end thereof to stop withdrawal of said inside groups of tiers, said rod being hidden within said groups of tiers so as not to be visible on the outer surfaces of said groups of tiers when the grandstand arrangement is unfolded.

6. A tiered grandstand arrangement according to claim 1; wherein each tier consists of a vertical riser portion and a horizontal portion, with the latter being formed of a pair of horizontal stages joined by a riser wall, the same serving both to separate the area on which individuals seated on a given tier can sit from the area on which the individuals seated on the next tier thereabove can rest their feet, and also to stiffen the structure of the groups of tiers.

7. A tiered grandstand arrangement according to claim 6; wherein said riser wall slopes obliquely forward.

8. A tiered grandstand arrangement according to claim 7; wherein the height of said vertical riser portion is substantially forty centimeters, and the width of said horizontal portion is substantially sixty centimeters, with each of said pair of horizontal stages having a width of substantially twenty-five centimeters and said obliquely sloping riser wall having a height of substantially ten centimeters.

9. A tiered grandstand arrangement according to claim 1; wherein a vertical slidebar is disposed at the outer end of at least the inner group of tiers associated with said first group of tiers permitting detachable insertion of a prop supporting the outer end thereof from the ground and of a post for supporting handrails.

10. A tiered grandstand arrangement according to claim 1; wherein the distance from said axis joining the first and second groups of tiers to the lowest portion of said second group of tiers, when in the unfolded position, is substantially equal to the distance between said axis and the lowest portion of said wheels.

* * * * *